US006193060B1

(12) United States Patent
Roberts et al.

(10) Patent No.: US 6,193,060 B1
(45) Date of Patent: Feb. 27, 2001

(54) FRONT OPENING CIGARETTE BOX

(75) Inventors: David L. Roberts, Clover, VA (US); Donald H. Evers, Lake Forrest, IL (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/504,922

(22) Filed: Feb. 16, 2000

(51) Int. Cl.[7] ..... B65D 85/10

(52) U.S. Cl. ..... 206/268; 206/273; 229/146; 229/147

(58) Field of Search ..... 206/242, 265, 206/268, 271, 273, 443; 220/836, 837, 839; 229/160.1, 146, 147

(56) References Cited

U.S. PATENT DOCUMENTS

| | | | | |
|---|---|---|---|---|
| 1,354,042 | * | 9/1920 | Hunziker | 206/268 |
| 2,113,277 | * | 4/1938 | Muller | 229/146 |
| 2,120,258 | * | 6/1938 | Moore | 206/273 |
| 2,964,228 | * | 12/1960 | Cote et al. | 229/147 |
| 3,342,399 | | 9/1967 | Reynolds . | |
| 3,459,359 | | 8/1969 | Heffernan . | |
| 3,596,823 | | 8/1971 | Zitzelman . | |
| 3,866,747 | | 2/1975 | Scholtz . | |
| 4,170,327 | | 10/1979 | Bruml . | |
| 4,570,790 | | 2/1986 | Turnage . | |
| 4,607,748 | | 8/1986 | Focke . | |
| 4,763,779 | | 8/1988 | Focke et al. . | |
| 5,938,018 | * | 8/1999 | Keaveney et al. | 206/268 |

* cited by examiner

*Primary Examiner*—Luan K. Bui
(74) *Attorney, Agent, or Firm*—Connolly Bove Lodge & Hutz

(57) ABSTRACT

A front opening cigarette box comprises a container portion and an integral cover portion which articulates between opened and closed positions. The container portion includes a front face, a rear face generally parallel to the front face, a bottom face, and spaced apart side walls interconnecting the front and rear faces. The cover portion includes a front face that fully covers the container portion when the cover portion is in its closed position. The cover portion also includes top and bottom faces, and a rear face contiguous with and forming a continuation of the rear face of the container portion when the cover portion is in its closed position. Spaced apart side walls on the cover portion interconnect the front and rear faces thereof. A hinge line extends between the rear faces of the container and cover portions, and the cover portion articulates about that hinge line between its opened and closed positions. Such front opening cigarette box provides easy access to the individual cigarettes within the container portion and total access to the upper ends of the individual cigarettes when the cover portion is in its opened position.

7 Claims, 3 Drawing Sheets

FRONT OPENING CIGARETTE BOX

BACKGROUND OF THE INVENTION

The present invention relates to a front opening cigarette box having a container portion and a cover portion which articulates along a hinge line between opened and closed positions. A plural of cigarettes normally wrapped in a foil wrapping is received with the container portion such that the cigarettes lie flat therein, usually in several layers one above the other.

Front opening cigarette boxes are known in the prior art but their designs and constructions are intricate and cumbersome. The blanks from which they are fabricated have numerous fold and cut lines and they are unduly complicated. Moreover, in many instances the cigarettes in such boxes are difficult to remove particularly the lowermost layer of cigarettes in the box.

SUMMARY OF THE INVENTION

Accordingly, one of the objects of the present invention is a front opening cigarette box which is simple in construction and easy to open and close.

Another object of the present invention is a front opening cigarette box which totally exposes the upper end portions of all the cigarettes in the box when the cover is fully open for ease of cigarette removal.

Still another object of the present invention is front opening cigarette box fabricated from a one piece blank having a minimum of fold and cut lines which is easily assembled into the finished box construction.

In accordance with the present invention a front opening cigarette box comprises a container portion and an integral cover portion which articulates between opened and closed positions about a horizontal hinge line. The container portion includes a front face, a rear face generally parallel to the front face, a bottom face and spaced apart side walls interconnecting the front and rear faces. The cover portion includes a front face that fully covers the container portion when the cover portion is in its closed position. The cover portion also includes top and bottom faces, a rear face contiguous with and forming a continuation of the rear face of the container portion when the cover portion is in its closed position. Spaced apart side walls on the cover portion interconnect the front and rear faces thereof. The horizontal hinge line extends along the juncture of the rear faces of the container and cover portions.

Preferably the bottom face of the cover portion extends over the bottom face of the container portion when the cover portion is in its closed position. The front face of the cover portion has an area approximately equal to the area of the combined rear faces of the container and cover portions. Moreover, the side walls of the container portion preferably extend from the bottom face of the container portion to the horizontal hinge line, and the side walls of the container portion each have an upper inclined edge extending from the hinge line in a downward direction to the front face of the container portion.

The side walls of the cover portion each include an upper segment that extends between the front and rear faces of the cover portion and a lower segment that partially covers the side walls of the container portion when the cover portion is in its closed position. Preferably, the front face of the container portion includes an open area exposing cigarettes in the container portion for easy access and removal when the cover portion is in its opened position.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 4:
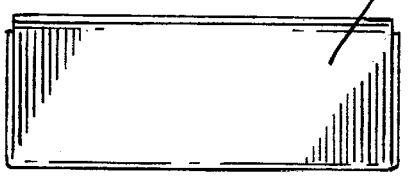
FIG. 4 is a top plan view of the front opening cigarette box shown in FIGS. 1–3, according to the present invention.
Figure 1:
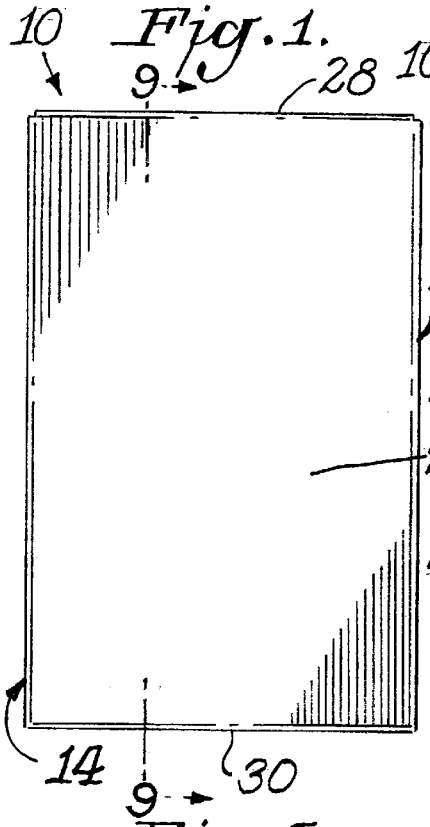
FIG. 1 is a front elevational view of a front opening cigarette box in its closed position, according to the present invention.

Referring in more particularity to the drawings, FIGS. 1–5 illustrate a front opening cigarette box 10, according to the present invention. These figures illustrate front opening cigarette box 10 in its closed position. Fundamentally, the front opening cigarette box of the present invention comprises a container portion 12 and a cover portion 14 which articulates between closed and opened positions about a horizontal hinge line 16.

Container portion 12 includes a front face 18 (best shown in FIG. 7), a rear face 20 generally parallel to the front face 18, a bottom face 22, and spaced apart side walls 24 that interconnect the front and rear faces 18 and 20, respectively.

Figure 2:
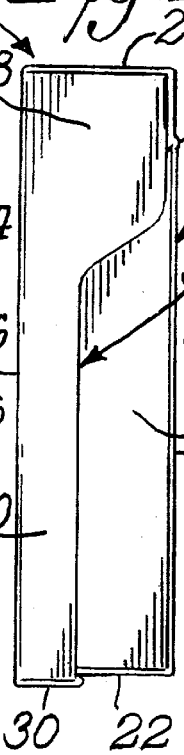
FIG. 2 is a right side elevational view of the front opening cigarette box shown in FIG. 1, the left side elevational view being a mirror image duplicate.
Figure 3:
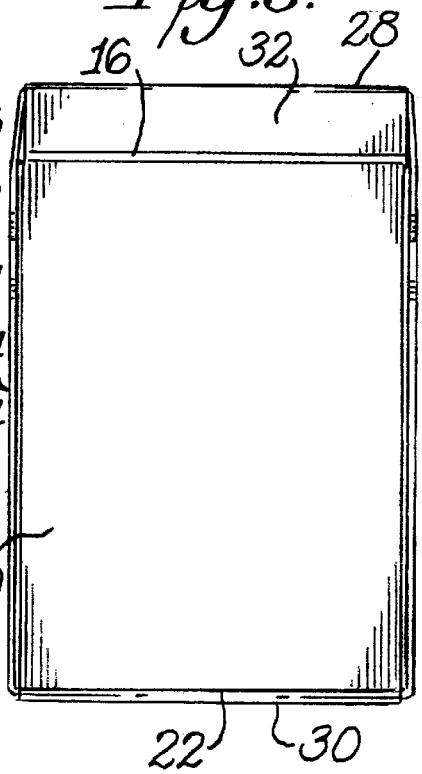
FIG. 3 is a rear elevational view of the front opening cigarette box shown in FIGS. 1 and 2, according to the present invention.
Figure 5:
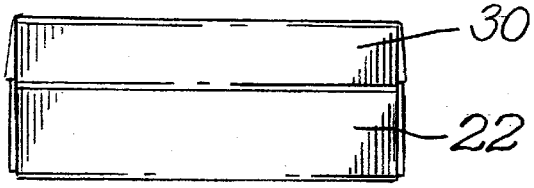
FIG. 5 is a bottom plan view of the front opening cigarette box shown in FIGS. 1–4, according to the present invention.

Cover portion 14 includes a front face 26 that fully covers container portion 12 when the cover portion is in its closed position shown in FIGS. 1–5. The cover portion also includes top and bottom faces 28, 30, and a rear face 32 contiguous with and forming a continuation of rear face 20 of container portion 12 when the cover portion is in its closed position. This relationship between the rear faces of the container and cover portions is best shown in FIGS. 2 and 3. Spaced apart side walls 34 interconnect the front and rear faces of the cover portion.

The bottom face 30 of cover portion 14 extends over the bottom face 22 of container portion 12 when the cover portion is in its closed position. Moreover, as shown best in FIGS. 1 and 3, the front face 26 of cover portion 14 has an area approximately equal to the area of the combined rear faces 20, 32 of the container and cover portions.

Figure 8:
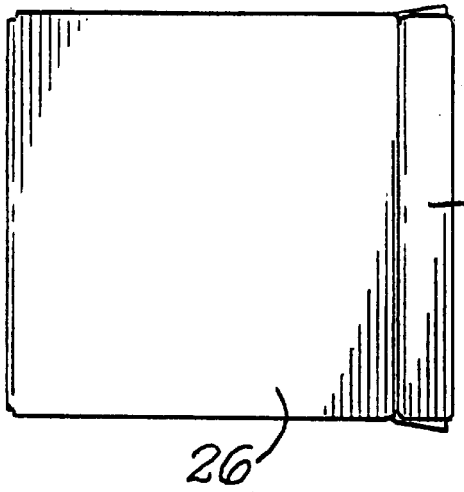
FIG. 8 is a top plan view of the front opening cigarette box shown in FIGS. 6 and 7, according to the present invention.
Figure 6:
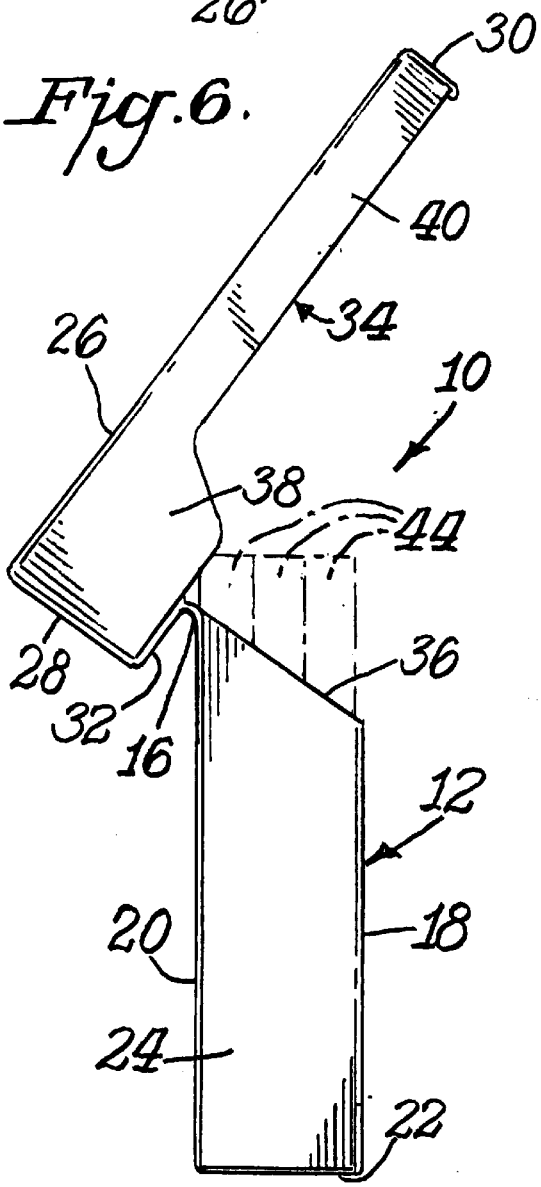
FIG. 6 is a left side elevational view of the front opening cigarette box in its opened position, according to the present invention.
Figure 7:
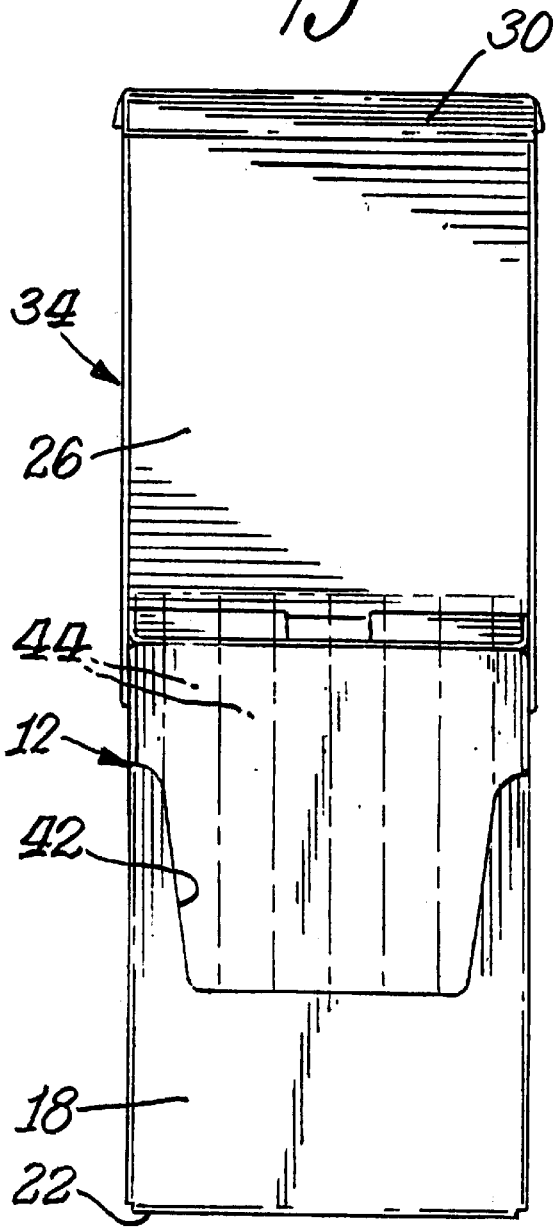
FIG. 7 is a front elevational view of the front opening cigarette box shown in FIG. 6, according to the present invention.
Figure 9:
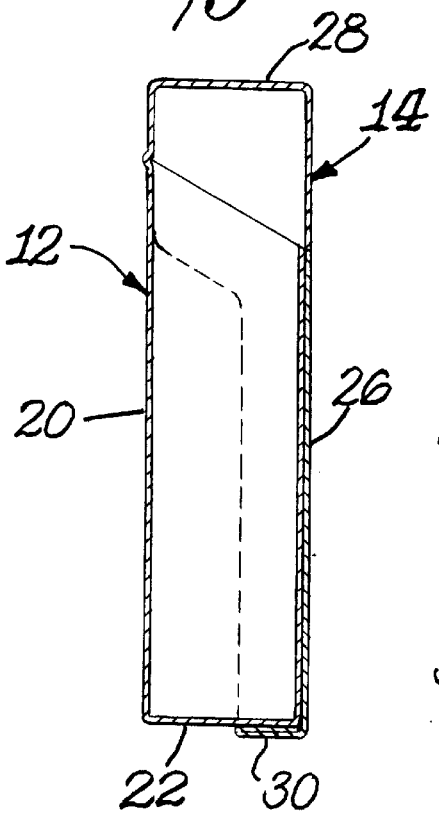
FIG. 9 is a cross-sectional view in elevation taken along line 9—9 of FIG. 1.

FIGS. 6–8 illustrate front opening cigarette box 10 in its opened position. As shown in FIG. 6, the side walls 24 of container portion 12 extend from bottom face 22 to horizontal hinge line 16. Also, the side walls 24 of container portion 12 each have an upper inclined edge 36 that extends from hinge line 16 in a downward direction to the front face 18 of container portion 12.

As shown best in FIGS. 2 and 6, the side walls 34 of cover portion 14 each include an upper segment 38 that extends between the front and rear faces 26, 32 of cover portion 14 and a lower segment 40 that partially covers the side walls 24 of container portion 12 when the cover portion is in its closed position.

The front face 18 of container portion 12 includes an open area 42 exposing cigarettes (not shown) in the container portion for easy access and removal when cover portion 14 is in its opened position. In actual use a plurality of cigarette surrounded by a foil wrap is inserted into the container portion. Front opening cigarette box 10 provides easy access to the individual cigarettes within the container portion and total access to upper ends of individual cigarettes when the cover portion is in its opened position. Positioning a hinge line 16 below the top face 28 of cover portion 14 fully exposed the upper ends of individual cigarettes so that the cigarettes may be easily grasped for removal when desired.

Figure 10:
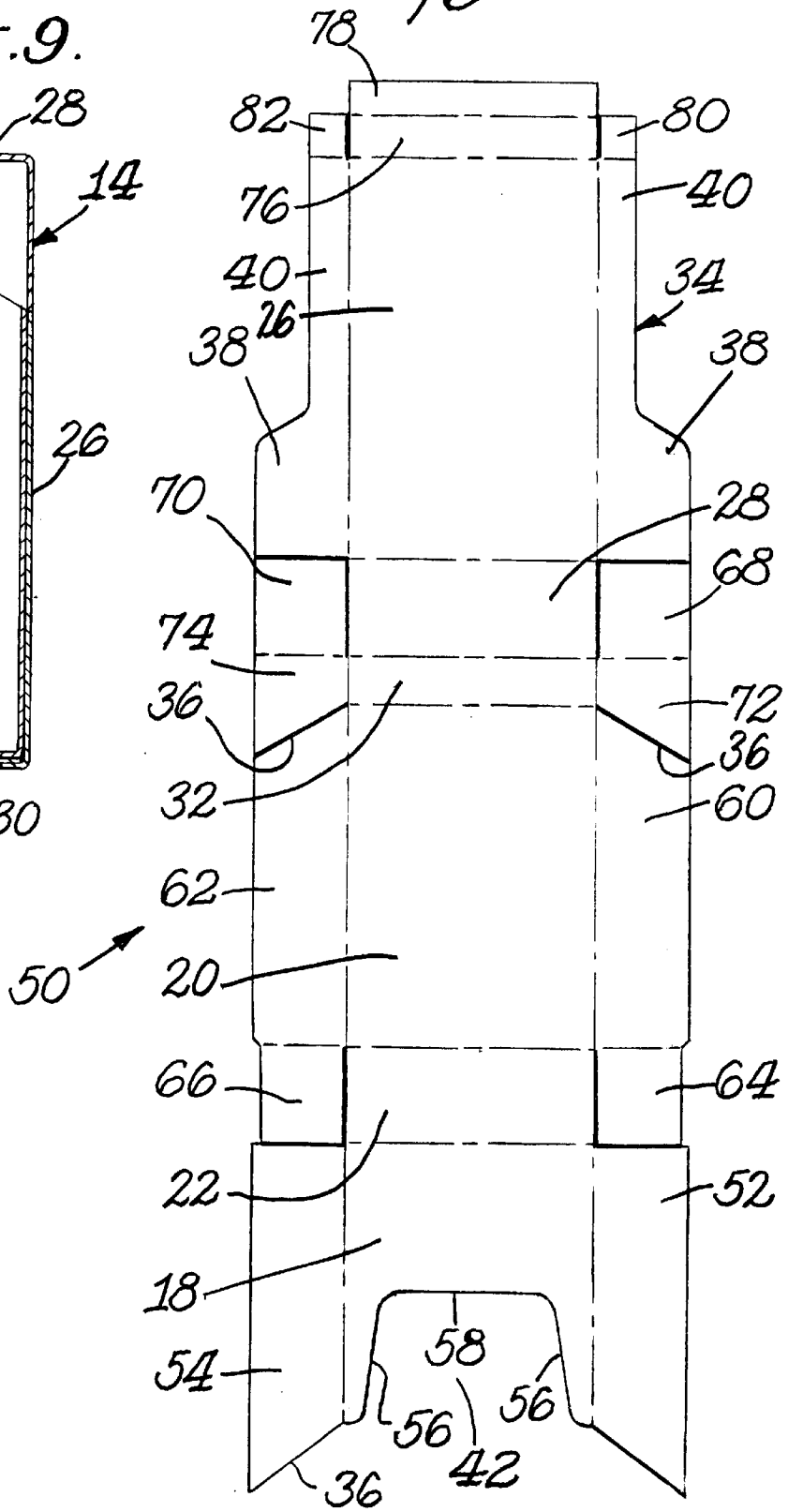
FIG. 10 is a blank pattern layout of reduced scale for the front opening cigarette box shown in FIGS. 1–9.

FIG. 10 illustrates a blank pattern layout 50 of reduced scale for producing front opening cigarette box 10. Blank 10 includes front face 18 of container portion 12 as well as a container right side wall front tab 52 and container left side wall front tab 54. Front face 18 includes side edges 56 converging toward one another and transverse edge 58 that collectively define open area 42 on the front face of the container portion.

Blank 50 also includes rear face 20 of container portion 12 as well as a right container side wall back tab 60 and left container side wall back tab 62. A right side bottom tab 64 extends from tab 60 and a left side bottom tab 66 extends from tab 62. When container portion 12 of the front opening cigarette box is formed, the right and left side bottom tabs 64, 66 are folded inwardly onto bottom face 22 and secured with adhesive while tabes 52 and 60 overlap one another and tabs 54 and 62 overlap one another to form the side walls 24. Adhesive is used to hold these tabs together.

With respect to cover portion 14, blank 50 includes rear face 32, top face 28, front face 26 and side walls 34. Blank 50 further includes a right side top tab 68 and a left side top tab 70. A right cover side wall back tab 72 extends from tab 68 and a left cover side wall back tab 74 extends from tab 70.

Bottom face 30 of cover portion 14 is formed by an outside cover end wall 76, an inside cover end wall 78, a right side cover end wall tab 80 and a left side cover end wall tab 82. Cover portion 14 is formed by positioning tabs 68, 70 against top face 28 and securing these tabs in place by adhesive. Side walls 34 are folded into position and tabs 72, 74 are secured to the upper segments 38 of these side walls. Bottom face 30 is formed by positioning tabs 80, 82 onto outside cover end wall 76 and then securing inside cover end wall 78 onto outside cover end wall 76 by adhesive. The assembled front opening cigarette box is then ready for insertion of the foil wrapped cigarettes and completion of the packaging process.

What is claimed is:

1. A front opening cigarette box comprising a container portion and an integral cover portion which articulates between opened and closed positions, the container portion including a front face, a rear face generally parallel to the front face, a bottom face, and spaced apart side walls interconnecting the front and rear faces, the cover portion including a front face fully covering the container portion when the cover portion is in its closed position, top and bottom faces, a rear face contiguous with and forming a continuation of the rear face of the container portion when the cover portion is in its closed position, and spaced apart side walls interconnecting the front and rear faces of the cover portion, and a hinge line extending between the rear faces of the container and cover portions.

2. A front opening cigarette box as in claim 1 wherein the bottom face of the cover portion extends over the bottom face of the container portion when the cover portion is in its closed position.

3. A front opening cigarette box as in claim 2 wherein the front face of the cover portion has an area approximately equal to the area of the combined rear faces of the container and cover portions.

4. A front opening cigarette box as in claim 1 wherein the side walls of the container portion extend from the bottom face of the container portion to the hinge line.

5. A front opening cigarette box as in claim 4 wherein the side walls of the container portion each have an upper inclined edge extending from the hinge line in a downward direction to the front face of the container portion.

6. A front opening cigarette box as in claim 1 wherein the side walls of the cover portion each include an upper segment that extends between the front and rear faces of the cover portion and a lower segment that partially covers the side walls of the container portion when the cover portion is in its closed position.

7. A front opening cigarette box as in claim 1 wherein the front face of the container portion includes an open area exposing cigarettes in the container portion for easy access and removal when the cover portion is in its opened position.

* * * * *